US012442060B2

(12) United States Patent
Kido et al.

(10) Patent No.: US 12,442,060 B2
(45) Date of Patent: Oct. 14, 2025

(54) CEMENTED CARBIDE

(71) Applicant: Sumitomo Electric Industries, Ltd., Osaka (JP)

(72) Inventors: Yasuki Kido, Osaka (JP); Yoshihiro Kimura, Osaka (JP); Anongsack Paseuth, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/713,208

(22) PCT Filed: Sep. 26, 2023

(86) PCT No.: PCT/JP2023/035010
§ 371 (c)(1),
(2) Date: May 24, 2024

(87) PCT Pub. No.: WO2025/069214
PCT Pub. Date: Apr. 3, 2025

(65) Prior Publication Data

US 2025/0101549 A1 Mar. 27, 2025

(51) Int. Cl.
*C22C 29/08* (2006.01)
*C22C 29/06* (2006.01)

(52) U.S. Cl.
CPC ..... *C22C 29/08* (2013.01); *C22C 29/067* (2013.01)

(58) Field of Classification Search
CPC ..... C22C 29/08
See application file for complete search history.

(56) References Cited

U.S. PATENT DOCUMENTS 5,603,075 A * 2/1997 Stoll ..... F04B 39/0005 428/548
6,514,456 B1 2/2003 Lackner et al.
2007/0034048 A1* 2/2007 Liu ..... C22C 1/05 75/244
2012/0114960 A1 5/2012 Takesawa et al.
(Continued)

FOREIGN PATENT DOCUMENTS

EP 3147377 A1 3/2017
JP 2004-131769 A 4/2004
JP 2006-037160 A 2/2006
(Continued)

OTHER PUBLICATIONS

Tracey, V. "Development of Tungsten Carbide-Cobalt-Ruthenium Cutting Tools for Machining Steels." Modern Developments in Powder Metallurgy, 14 (1980): 281-292.*
(Continued)

*Primary Examiner* — Christopher S Kessler
(74) *Attorney, Agent, or Firm* — XSENSUS LLP

(57) ABSTRACT

Provided is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and a Young's modulus of the binder phase at 25° C. is 170 GPa or more, as measured by a nanoindenter method.

7 Claims, 1 Drawing Sheet

(56) References Cited

U.S. PATENT DOCUMENTS

2014/0246248 A1* 9/2014 Eason ..... E21B 10/46
175/425
2019/0345589 A1 11/2019 Konyashin et al.

FOREIGN PATENT DOCUMENTS

WO 2011/002008 A1 1/2011
WO 2015/178484 A1 11/2015

OTHER PUBLICATIONS

Bin Li et al., Effect of Re addition on the microstructure and mechanical properties of WC—10Co cemented carbides fabricated by chemical coating method, International Journal of Refractory Metals & Hard Materials 93 (2020) 10534.*
International Search Report and Written Opinion mailed on Dec. 12, 2023, received for PCT Application PCT/JP2023/035010, filed on Sep. 26, 2023, 14 pages including English Translation.

* cited by examiner

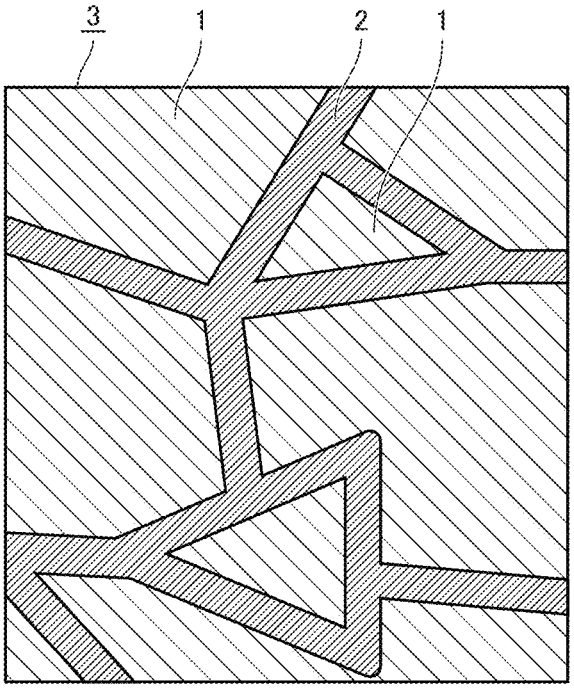
3
1
2
1

CEMENTED CARBIDE

CROSS-REFERENCE TO RELATED APPLICATION

The present application is based on PCT filing PCT/JP2023/035010, filed Sep. 26, 2023, the entire contents of which are incorporated herein by reference.

TECHNICAL FIELD

The present disclosure relates to a cemented carbide.

BACKGROUND ART

Conventionally, cemented carbides comprising a plurality of tungsten carbide grains and a binder phase have been utilized as materials for cutting tools (PTL 1).

CITATION LIST

Patent Literature

PTL 1: Japanese Patent Laying-Open No. 2004-131769

SUMMARY OF INVENTION

A cemented carbide of the present disclosure is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and a Young's modulus of the binder phase at 25° C. is 170 GPa or more, as measured by a nanoindenter method.

BRIEF DESCRIPTION OF DRAWING

FIG. 1 is a diagram schematically showing one cross-section of a cemented carbide of one embodiment of the present disclosure.

DETAILED DESCRIPTION

Problem to be Solved by the Present Disclosure

In recent years, workpieces have become increasingly difficult to cut in cutting processes, and the conditions under which cutting tools are used have become more severe. Therefore, improvement of various characteristics has also been demanded for cemented carbides used as base bodies for cutting tools. There has been a demand for a cemented carbide that enables a longer service life of tools, even in the case where it is used as a material for cutting tools for high efficiency processing of difficult-to-cut materials with particularly high tensile strength.

Therefore, an object of the present disclosure is to provide a cemented carbide that enables a longer service life of tools, even in the case where it is used as a material for cutting tools for high efficiency processing of difficult-to-cut materials with particularly high tensile strength.

Advantageous Effect of the Present Disclosure

According to the present disclosure, it is possible to provide a cemented carbide that enables a longer service life of tools, even in the case where it is used as a material for cutting tools for high efficiency processing of difficult-to-cut materials with particularly high tensile strength.

Description of Embodiments

First, embodiments of the present disclosure will be listed and described.

(1) A cemented carbide of the present disclosure is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and a Young's modulus of the binder phase at 25° C. is 170 GPa or more, as measured by a nanoindenter method.

According to the present disclosure, it is possible to provide a cemented carbide that enables a longer service life of tools, even in the case where it is used as a material for cutting tools for high efficiency processing of difficult-to-cut materials with particularly high tensile strength.

(2) In the above (1), the binder phase may further contain a first element, and the first element may be at least one element selected from the group consisting of silicon, phosphorus, germanium, tin, rhenium, ruthenium, osmium, iridium, and platinum. As a result of this, it is possible to provide a cemented carbide that can further extend the tool life of cutting tools, even in high efficiency processing of difficult-to-cut materials with particularly high tensile strength.

(3) In the above (2), in the binder phase, the percentage $\{M1/(M1+M2)\}\times 100$ of the mass M1 of the first element to the sum M1+M2 of the mass M1 of the first element and the mass M2 of cobalt may be 1% or more and 6% or less. As a result of this, it is possible to provide a cemented carbide that can further extend the tool life of cutting tools, even in high efficiency processing of difficult-to-cut materials with particularly high tensile strength.

DETAILS OF EMBODIMENTS OF THE PRESENT DISCLOSURE

Hereinafter, a specific example of a cutting tool of one embodiment of the present disclosure (hereinafter, also referred to as "the present embodiment") will be described with reference to a drawing. In the drawing of the present disclosure, the same reference signs represent the same portions or equivalent portions. In addition, dimensional relationships such as length, width, thickness, and depth are changed as appropriate for clarity and simplicity in the drawing and do not necessarily represent actual dimensional relationships.

In the present disclosure, the expression "A to B" represents a range of lower to upper limits (i.e., A or more and B or less), and in the case where no unit is indicated for A and a unit is indicated only for B, the unit of A is the same as the unit of B.

In the case where a compound or the like is expressed by a chemical formula in the present disclosure and an atomic ratio is not particularly limited, it is assumed that all the conventionally known atomic ratios are included, and the atomic ratio should not necessarily be limited only to one in the stoichiometric range.

Embodiment 1: Cemented Carbide

A cemented carbide according to one embodiment of the present disclosure will be described with reference to FIG. 1.

One embodiment of the present disclosure (hereinafter, also referred to as "the present embodiment") is a cemented carbide 3 comprising a plurality of tungsten carbide grains 1 and a binder phase 2, wherein cemented carbide 3 comprises tungsten carbide grains 1 and binder phase 2 in a total of 89% by volume or more, cemented carbide 3 comprises 1.8% by volume or more and 20.0% by volume or less of binder phase 2, binder phase 2 contains cobalt, cemented carbide 3 contains 1.0% by mass or more of cobalt, and a Young's modulus of the binder phase 2 at 25° C. is 170 GPa or more, as measured by a nanoindenter method.

According to the present disclosure, it is possible to provide cemented carbide 3 that enables a longer service life of tools, even in the case where it is used as a material for cutting tools for high efficiency processing of difficult-to-cut materials with particularly high tensile strength. The reason for this is presumed to be as follows.

Cemented carbide 3 of the present embodiment comprises plurality of tungsten carbide grains 1 (hereinafter, also referred to as "WC grains 1") and binder phase 2, and the total content of WC grains 1 and binder phase 2 in cemented carbide 3 is 89% by volume or more. According to this, cemented carbide 3 has high hardness and strength, and a cutting tool using cemented carbide 3 can have excellent breakage resistance.

Cemented carbide 3 of Embodiment 1 comprises 1.8% by volume or more and 20.0% by volume or less of binder phase 2, binder phase 2 contains cobalt, and cemented carbide 3 contains 1.0% by mass or more of cobalt. Furthermore, the Young's modulus of binder phase 2 at 25° C. is 170 GPa or more, as measured by a nanoindenter method, and binder phase 2 can have excellent Young's modulus under 25° C. conditions (in other words, room temperature conditions). According to this, the Young's modulus of cemented carbide 3 is improved, and a cutting tool using cemented carbide 3 can have excellent breakage resistance, even in high efficiency processing of difficult-to-cut materials with particularly high tensile strength.

<<Composition of Cemented Carbide>>

Cemented carbide 3 comprises tungsten carbide grains 1 and binder phase 2 in a total of 89% by volume or more. As a result of this, a Young's modulus of cemented carbide 3 can be enhanced. Cemented carbide 3 may comprise tungsten carbide grains 1 and binder phase 2 in a total of 90% by volume or more, may comprise them in a total of 91% by volume or more, or may comprise them in a total of 92% by volume or more. In cemented carbide 3, the upper limit of the total content of tungsten carbide grains 1 and binder phase 2 may be, for example, 100% by volume or less, may be 99% by volume or less, or may be 98% by volume or less. Cemented carbide 3 may comprise tungsten carbide grains 1 and binder phase 2 in a total of 90% by volume or more and 100% by volume or less, may comprise them in a total of 91% by volume or more and 100% by volume or less, or may comprise them in a total of 92% by volume or more and 100% by volume or less.

Cemented carbide 3 comprises 1.8% by volume or more and 20.0% by volume or less of binder phase 2. As a result of this, in cemented carbide 3, the Young's modulus and toughness can be enhanced. The lower limit of the content of binder phase 2 in cemented carbide 3 may be 2.0% by volume or more, may be 3.0% by volume or more, or may be 4.0% by volume or more. The upper limit of the content of binder phase 2 in cemented carbide 3 may be 19.0% by volume or less, may be 18.0% by volume or less, or may be 17.0% by volume or less. Cemented carbide 3 may comprise 2.0% by volume or more and 19.0% by volume or less of binder phase 2, may comprise 3.0% by volume or more and 18.0% by volume or less of binder phase 2, or may comprise 4.0% by volume or more and 17.0% by volume or less of binder phase 2.

Cemented carbide 3 of Embodiment 1 can be composed of plurality of tungsten carbide grains 1 and binder phase 2. In addition to tungsten carbide grains 1 and binder phase 2, cemented carbide 3 of the present embodiment can comprise other phases (not shown). Examples of the other phases include carbides, nitrides, or carbonitrides containing at least one second element selected from the group consisting of titanium (Ti), tantalum (Ta), niobium (Nb), zirconium (Zr), hafnium (Hf), and molybdenum (Mo). The composition of the other phases is, for example, TiCN, TaC, NbC, ZrC, HfC, or $Mo_2C$.

Cemented carbide 3 of Embodiment 1 can be composed of tungsten carbide grains 1, binder phase 2, and the other phases. The content of the other phases in cemented carbide 3 is permissible to the extent that the effects of the present disclosure are not impaired. For example, the content of the other phases in cemented carbide 3 may be more than 0% by volume and 20% by volume or less, may be more than 0% by volume and 18% by volume or less, or may be more than 0% by volume and 16% by volume or less. In this case, the total content of tungsten carbide grains 1 and binder phase 2 in cemented carbide 3 may be 80% by volume or more and less than 100% by volume, may be 82% by volume or more and less than 100% by volume, or may be 84% by volume or more and less than 100% by volume.

Cemented carbide 3 of Embodiment 1 can comprise impurities. Examples of the impurities include iron (Fe), calcium (Ca), oxygen (O), and sulfur(S). The content of the impurities in cemented carbide 3 is permissible to the extent that the effects of the present disclosure are not impaired. For example, the content of the impurities in cemented carbide 3 may be 0% by mass or more and less than 0.1% by mass. The content of the impurities in cemented carbide 3 is measured by inductively coupled plasma (ICP) emission spectroscopy (measurement device: "ICPS-8100" ™ manufactured by Shimadzu Corporation).

The method for measuring the content of tungsten carbide grains 1 in cemented carbide 3 [% by volume] and the content of binder phase 2 in cemented carbide 3 [% by volume] is as follows.

(A1) Cemented carbide 3 is cut out at an arbitrary position to expose a cross-section. The cross-section is subjected to mirror surface processing using CROSS SECTION POLISHER (manufactured by JEOL Ltd.).

(B1) The surface of cemented carbide 3 that has been subjected to the mirror surface processing is analyzed by scanning electron microscopy with energy dispersive X-ray spectroscopy (SEM-EDX) (device: "Gemini 450" ™ manufactured by Carl Zeiss AG) to identify the elements contained in cemented carbide 3.

(C1) The surface of cemented carbide 3 that has been subjected to the mirror surface processing is imaged using a scanning electron microscope (SEM) to obtain a backscattered electron image. The region to be imaged of the image taken is set at the center of the cross-section of cemented carbide 3, i.e., at a position that does not include portions where the properties clearly differ from those of the bulk portion, such as the vicinity of the surface of cemented carbide 3 (at a position where the entire region to be imaged is the bulk portion of cemented carbide 3). The observation magnification is 5000 times. The measurement conditions are an acceleration voltage of 3 kV, a current value of 2 nA, and a working distance (WD) of 5 mm.

(D1) The region to be imaged in the above (C1) is analyzed using an energy dispersive X-ray spectrometer attached to a SEM (SEM-EDX) to identify the distribution of the elements identified in the above (B1) in the region to be imaged, and an elemental mapping image is obtained.

(E1) The backscattered electron image obtained in the above (C1) is imported into a computer and subjected to a binarization process using image analysis software (OpenCV, SciPy). In the image after the binarization process, tungsten carbide grains 1 are shown in white, and binder phase 2 is shown in gray to black. Note that the threshold value of the binarization varies depending on the contrast, and is thus set for each image.

(F1) The elemental mapping image obtained in the above (D1) and the image after the binarization process obtained in the above (E1) are overlapped, thereby identifying the respective regions where tungsten carbide grains 1 and binder phase 2 are present on the image after the binarization process. Specifically, the region shown in white in the image after the binarization process where tungsten (W) and carbon (C) are present in the elemental mapping image corresponds to the region where tungsten carbide grains 1 are present. The region shown in gray to black in the image after the binarization process where cobalt (Co) is present in the elemental mapping image corresponds to the region where binder phase 2 is present.

(G1) In the image after the binarization process, one rectangular measurement field of 24.9 μm×18.8 μm is set. Using the above image analysis software, the respective area percentages of tungsten carbide grains 1 and binder phase 2 are measured with the area of the entire measurement field as the denominator.

(H1) The measurement of the above (G1) is performed at five different measurement fields that are not overlapped with each other. In the present specification, the average of the area percentages of tungsten carbide grains 1 in the five measurement fields corresponds to the content [% by volume] of tungsten carbide grains 1 in cemented carbide 3, and the average of the area percentages of binder phase 2 in the five measurement fields corresponds to the content [% by volume] of binder phase 2 in cemented carbide 3.

In the case where cemented carbide 3 comprises other phases in addition to tungsten carbide grains 1 and binder phase 2, the content of the other phases in cemented carbide 3 can be obtained by subtracting the content [% by volume] of tungsten carbide grains 1 and the content [% by volume] of binder phase 2 as measured in the above procedure from the entire cemented carbide 3 (100% by volume).

As far as the applicant has measured, it has been confirmed that, as long as measurement is performed on the same sample, even if the cut-out location for the cross-section of cemented carbide 3 is arbitrarily set, the region to be imaged described in the above (C1) is arbitrarily set on the cross-section, and the measurement of the content of tungsten carbide grains 1 and the content of binder phase 2 in cemented carbide 3 is performed multiple times according to the above procedure, the variation in measurement results was small and not arbitrary.

<<Binder Phase>>

Binder phase 2 contains cobalt, and cemented carbide 3 contains 1.0% by mass or more of cobalt. As a result of this, excellent toughness can be imparted to cemented carbide 3. Note that binder phase 2 may contain 50% by mass or more of cobalt, may contain 60% by mass or more of cobalt, may contain 70% by mass or more of cobalt, may contain 80% by mass or more of cobalt, may contain 90% by mass or more of cobalt, or may contain 95% by mass or more of cobalt. Binder phase 2 may be composed of cobalt. Alternatively, binder phase 2 may be composed of cobalt and a first element described later. Also, cobalt in cemented carbide 3 may be present only in binder phase 2. The lower limit of the content of cobalt in cemented carbide 3 may be 2.0% by mass or more, may be 3.0% by mass or more, or may be 4.0% by mass or more. The upper limit of the content of cobalt in cemented carbide 3 may be 20% by mass or less, may be 15% by mass or less, may be 12% by mass or less, or may be 10% by mass or less. Cemented carbide 3 may contain 1.0% by mass or more and 20% by mass or less of cobalt, may contain 2.0% by mass or more and 15% by mass or less of cobalt, or may contain 3.0% by mass or more and 12% by mass or less of cobalt.

A method for measuring the content of cobalt in cemented carbide 3 is as follows. At first, by the same method as (A1) to (C1) of the method for measuring the content of tungsten carbide grains 1 and the content of binder phase 2 in cemented carbide 3 described above, the region to be imaged is set. Next, the region to be imaged is analyzed using SEM-EDX to identify the distribution of the elements identified in the above (B1) in the region to be imaged, and an elemental mapping image is obtained while at the same time identifying the content of cobalt in cemented carbide 3. Note that a method for measuring the "cobalt content in binder phase 2" is as follows. At first, by the same method as (A1) to (F1) of the method for measuring the content of tungsten carbide grains 1 and the content of binder phase 2 in cemented carbide 3 described above, the region where binder phase 2 is present is identified on the image after the binarization process. Next, the region where binder phase 2 is present is analyzed using SEM-EDX to measure the "cobalt content in binder phase 2". Also, a method for identifying "cobalt in cemented carbide 3 is present only in binder phase 2" is as follows. At first, by the same method as (A1) to (F1) of the method for measuring the content of tungsten carbide grains 1 and the content of binder phase 2 in cemented carbide 3 described above, the region where tungsten carbide grains 1 are present and the region where binder phase 2 is present are identified on the image after the binarization process. Next, based on the elemental mapping image, as well as the region where tungsten carbide grains 1 are present and the region where binder phase 2 is present, "cobalt in cemented carbide 3 is present only in binder phase 2" is identified.

As far as the applicant has measured, it has been confirmed that, as long as measurement is performed on the same sample, even if the cut-out location for the cross-section of cemented carbide 3 and the region to be imaged described in the above (C1) are arbitrarily set, and the above measurement is performed multiple times according to the above procedure, the variation in measurement results was small and not arbitrary.

Binder phase 2 may further contain a first element, and the first element may be at least one element selected from the group consisting of silicon, phosphorus, germanium, tin, rhenium, ruthenium, osmium, iridium, and platinum. As a result of this, it is possible to provide cemented carbide 3 that can further extend the tool life of cutting tools, even in high efficiency processing of difficult-to-cut materials with particularly high tensile strength.

The content of the first element in cemented carbide 3 may be 0.01% by mass or more and 1.0% by mass or less. As a result of this, binder phase 2 can have more excellent Young's modulus and more excellent toughness in combination. Note that the content of the first element in binder phase 2 may be 50% by mass or less, may be 40% by mass or less, may be 30% by mass or less, may be 20% by mass or less, may be 10% by mass or less, or may be 5% by mass or less. The first element in cemented carbide 3 may be present only in binder phase 2. The lower limit of the content of the first element in cemented carbide 3 may be 0.01% by mass or more, may be 0.04% by mass or more, or may be 0.1% by mass or more. The upper limit of the content of the first element in cemented carbide 3 may be 1.0% by mass or less, may be 0.8% by mass or less, or may be 0.6% by mass or less. The content of the first element in cemented carbide 3 may be 0.04% by mass or more and 0.8% by mass or less, or may be 0.1% by mass or more and 0.6% by mass or less.

A method for measuring the content of the first element in cemented carbide 3 is as follows. The measurement is carried out by the same method as the method for measuring the content of cobalt in cemented carbide 3, except that "cobalt" is replaced by "the first element". Note that a method for measuring the "content of the first element in binder phase 2" is as follows. The measurement is carried out by the same method as the method for measuring the "cobalt content in binder phase 2", except that "Next, . . . to measure the "cobalt' content in binder phase 2"" is replaced by "Next, . . . to measure the 'content of 'the first element' in binder phase 2'". Also, a method for identifying "the first element in cemented carbide 3 is present only in binder phase 2" is as follows. The measurement is carried out by the same method as the method for identifying "cobalt in cemented carbide 3 is present only in binder phase 2", except that "Next, . . . "cobalt' in cemented carbide 3 is present only in binder phase 2' is identified" is replaced by "Next, . . . "the first element' in cemented carbide 3 is present only in binder phase 2' is identified".

As far as the applicant has measured, it has been confirmed that, as long as measurement is performed on the same sample, even if the cut-out location for the cross-section of cemented carbide 3 and the region to be imaged described in the above (C1) are arbitrarily set, and the above measurement is performed multiple times according to the above procedure, the variation in measurement results was small and not arbitrary.

In binder phase 2, the percentage {M1/(M1+M2)}×100 of the mass M1 of the first element to the sum M1+M2 of the mass M1 of the first element and the mass M2 of cobalt may be 1% or more and 6% or less. As a result of this, binder phase 2 can have more excellent Young's modulus and more excellent toughness in combination, and therefore, it is possible to provide cemented carbide 3 that can further extend the tool life of cutting tools, even in high efficiency processing of difficult-to-cut materials with particularly high tensile strength. Here, the mass M1 of the first element means, in the case where the binder phase contains two or more first elements, the total mass of all first elements. The lower limit of the percentage {M1/(M1+M2)}×100 may be 1% or more, may be 2% or more, or may be 3% or more. The upper limit of the percentage {M1/(M1+M2)}×100 may be 6% or less, may be 5% or less, or may be 4% or less. The percentage {M1/(M1+M2)}×100 may be 2% or more and 5% or less, or may be 3% or more and 4% or less.

A method for measuring the above percentage {M1/(M1+M2)}×100 is as follows. By the same method as (A1) to (F1) of the method for measuring the content of tungsten carbide grains 1 and the content of binder phase 2 in cemented carbide 3 described above, the region where binder phase 2 is present is identified on the image after the binarization process. The region where binder phase 2 is present is analyzed using SEM-EDX to measure the cobalt content and first element content in binder phase 2, and based on them, the percentage {M1/(M1+M2)}×100 is calculated. The above measurement is performed at five different measurement fields that are not overlapped with each other. In the present specification, the average of the percentages {M1/(M1+M2)}×100 in the five measurement fields corresponds to "the percentage {M1/(M1+M2)}×100" in binder phase 2.

As far as the applicant has measured, it has been confirmed that, as long as measurement is performed on the same sample, even if the cut-out location for the cross-section of cemented carbide 3 and the region to be imaged described in the above (C1) are arbitrarily set, and the measurement of the percentage {M1/(M1+M2)}×100 is performed multiple times according to the above procedure, the variation in measurement results was small and not arbitrary.

<Young's Modulus of Binder Phase>

The Young's modulus of binder phase 2 at 25° C. is 170 GPa or more, as measured by a nanoindenter method. As a result of this, binder phase 2 can have excellent Young's modulus under 25° C. conditions (in other words, room temperature conditions). The lower limit of the Young's modulus may be 180 GPa or more, may be 190 GPa or more, or may be 200 GPa or more. The upper limit of the Young's modulus may be 230 GPa or less, may be 220 GPa or less, may be 210 GPa or less, or may be 198 GPa or less. The Young's modulus may be 170 GPa or more and 230 GPa or less, may be 180 GPa or more and 220 GPa or less, or may be 190 GPa or more and 210 GPa or less.

The Young's modulus of binder phase 2 at 25° C. as measured by a nanoindenter method is measured by a nanoindenter method ("Hysitron TI 980 TriboIndenter" manufactured by Bruker). The nanoindenter method is a method in accordance with ISO 14577 and is carried out under the following conditions: the measurement load is 0.5 mN, the loading time is 0.1 seconds, the load holding time is 0.1 seconds, and the unloading time is 0.1 seconds. The measurement subject is each of arbitrary ten binder phases 2 in total exposed by polishing the surface of cemented carbide 3 using a cross section polisher (CP) processing device ("IB-19500CP Cross Section Polisher" ™ manufactured by JEOL Ltd.). The average value of the respective Young's moduli of the ten binder phases 2 in total is defined as the above "Young's modulus of binder phase 2".

As far as the applicant has measured, it has been confirmed that, as long as measurement is performed on the same sample, even if the ten binder phases 2 are arbitrarily set and the measurement of the Young's modulus of binder phase 2 is performed multiple times, the variation in measurement results was small and not arbitrary.

<<Tungsten Carbide Grains>>

In Embodiment 1, tungsten carbide grains 1 include at least any of "pure WC grains (including WC not containing any impurity elements, as well as WC in which the content of impurity elements is below the detection limit)" and "WC grains in which impurity elements are intentionally or inevitably contained therein to the extent that the effects of the present disclosure are not impaired". The content of impurities in the tungsten carbide grains (in the case where there are two or more elements constituting the impurities, their total content) is less than 0.1% by mass. The content of the impurity elements in the tungsten carbide grains is measured by inductively coupled plasma (ICP) emission spectroscopy (measurement device: "ICPS-8100" ™ manufactured by Shimadzu Corporation).

In Embodiment 1, the average grain size of tungsten carbide grains 1 is not particularly restricted. The average grain size of tungsten carbide grains 1 can be, for example, 0.5 μm or more and 3 μm or less. It has been confirmed that cemented carbide 3 of Embodiment 1 can have a long tool life regardless of the average grain size of tungsten carbide grains 1.

<Application of Cemented Carbide>

Cemented carbide 3 of the present embodiment may be used for cutting tools. Examples of the cutting tools include cutting tools for general purpose processing. More specific examples thereof include cutting tools such as a drill, an end mill, an indexable cutting insert for drills, an indexable cutting insert for end mills, an indexable cutting insert for milling, an indexable cutting insert for turning, a metal saw, a gear cutting tool, a reamer, and a tap.

Embodiment 2: Method for Producing Cemented Carbide

The cemented carbide of the present embodiment can be produced by performing a raw material powder preparation step, a mixing step, a molding step, a sintering step, a cooling step, and a hot isostatic pressing (HIP) step in the order described above. Each step will be described below.

<Preparation Step>

The preparation step is a step of preparing raw material powders of the materials that constitute the cemented carbide. Examples of the raw material powders include a tungsten carbide powder (hereinafter, also referred to as "WC powder") and a cobalt (Co) powder. In addition to these raw material powders, a first element powder, a niobium carbide (NbC) powder, a tantalum carbide (TaC) powder, a titanium carbonitride (TiCN) powder, a zirconium carbide (ZrC) powder, and the like can be prepared. As these raw material powders, those commercially available can be used. The average grain size of these raw material powders is not particularly restricted, and it can be 0.5 to 2 μm, for example. The average grain size of the raw material powders means an average grain size measured by the Fisher Sub-Sieve Sizer (FSSS) method. The average grain size is measured using "Sub-Sieve Sizer Model 95" (TM) manufactured by Fisher Scientific International, Inc.

<Mixing Step>

The mixing step is a step of mixing each raw material powder prepared in the preparation step at a predetermined proportion. A mixed powder in which each raw material powder is mixed is obtained by the mixing step. The mixing proportion of each raw material powder is adjusted as appropriate depending on the composition of the target cemented carbide. The first element powder may be used as a raw material powder. As a result of this, it becomes easier to align the crystalline orientation of the binder phase, which in turn makes it easier for the cemented carbide to have the desired "Young's modulus of a binder phase at 25° C. as measured by a nanoindenter method". By adjusting the amount of each raw material powder to be charged as appropriate, the respective contents of the binder phase and WC grains can be set within the desired ranges.

For the mixing of each raw material powder, conventionally known mixing methods such as an attritor, a ball mill, and a bead mill can be used. The mixing conditions used can also be conventionally known conditions. The mixing time can be 2 hours or longer and 20 hours or shorter, for example.

After the mixing step, the mixed powder may be granulated as necessary. By granulating the mixed powder, it is easy to fill a die or mold with the mixed powder during the molding step described later. Known granulation methods can be applied for the granulation, and for example, a commercially available granulator such as a spray dryer can be used.

<Molding Step>

The molding step is a step of molding the mixed powder obtained in the mixing step into a shape for cutting tools to obtain a molded body. The molding method and molding conditions in the molding step are not particularly restricted as long as general methods and conditions may be employed.

<Sintering Step>

The sintering step is a step of sintering the molded body obtained in the molding step to obtain a cemented carbide intermediate. The sintering conditions in the present embodiment are as follows. The molded body is heated to 1340° C. and held at 1340° C. for 2 hours.

<Cooling Step>

The cooling step is a step of cooling the cemented carbide intermediate after the sintering step. More specifically, the cemented carbide intermediate is cooled to 800° C. (hereinafter, also referred to as "first cooling"). The cooling rate of the first cooling is, for example, 2° C./min.

<HIP Step>

The HIP step is a step of performing a HIP treatment on the cemented carbide intermediate after the cooling step. The conditions for the HIP step in the present embodiment are as follows. The cemented carbide intermediate is held under the conditions where the pressure is 10 MPa for 4 hours. As a result of this, the cemented carbide of Embodiment 1 can be obtained.

<Characteristics of Method for Producing Cemented Carbide of the Present Embodiment>

In the present embodiment, the sintering step is carried out by heating the molded body to 1340° C. and holding it at 1340° C. for 2 hours. Furthermore, the cooling step is carried out by setting the cooling rate until 800° C. to 2° C./min. Furthermore, the HIP step is carried out under the conditions where the pressure is 10 MPa and the time is 4 hours. By these steps, the cemented carbide can be produced in which the Young's modulus of the binder phase at 25° C. is 170 GPa or more, as measured by a nanoindenter method. The fact that the cemented carbide of the present disclosure can be realized by such sintering conditions, cooling step, and HIP step has been newly found by the present inventors as a result of careful examination.

[Note 1]

In the cemented carbide of Embodiment 1, the nanoindenter method is a method in accordance with ISO 14577 and may be carried out under the following conditions: the measurement load is 0.5 mN, the loading time is 0.1 seconds, the load holding time is 0.1 seconds, and the unloading time is 0.1 seconds.

Examples

The present embodiment will be described more specifically with reference to examples. However, the present embodiment is not limited by these examples.

<<Production of Cemented Carbide>>

In the following manner, cemented carbides according to Samples 1 to 20 and 101 to 112 were produced.

<Preparation Step>

As the raw material powders, a WC powder (average grain size: 1 μm), a Co powder (average grain size: 1 μm), a first element powder, and a TiCN powder (average grain size: 1 μm) were prepared. As the first element powder, a Si powder (average grain size: 1 μm), a Ge powder (average grain size: 1 μm), a Sn powder (average grain size: 1 μm), an Os powder (average grain size: 1 μm), an Ir powder (average grain size: 1 μm), a Pt powder (average grain size: 1 μm), a P powder (average grain size: 1 μm), a Re powder (average grain size: 1 μm), and a Ru powder (average grain size: 1 μm) were prepared.

<Mixing Step>

Each raw material powder was mixed in the proportion described in Table 1 and Table 2 for 10 hours using an attritor to obtain a mixed powder.

<Molding Step>

The mixed powder was subjected to press molding or extrusion molding to obtain a round bar-shaped molded body.

<Sintering Step>

The molded body was heated to the temperature described in Table 1 and Table 2 and held at a state of that temperature for the holding time described in Table 1 and Table 2, thereby obtaining a cemented carbide intermediate.

<Cooling Step>

The cemented carbide intermediate was cooled to 800° C. at the cooling rate described in Table 1 and Table 2.

<HIP Step>

A HIP treatment was carried out on the cemented carbide intermediate after the cooling step under the conditions described in Table 1 and Table 2, thereby obtaining a cemented carbide.

By the above procedure, the cemented carbides according to Samples 1 to 20 and 101 to 112 were produced.

TABLE 1

| | Mixing step | | | | | | Sintering step | | Cooling step | HIP step | |
|---|---|---|---|---|---|---|---|---|---|---|---|
| Sample No. | WC powder [% by mass] | Co powder [% by mass] | First element powder [% by mass] | Type of first element | TaC powder [% by mass] | TiCN powder [% by mass] | Temperature [° C.] | Holding time [hours] | Cooling rate [° C./min] | Pressure [MPa] | Time [hours] |
| 1 | Remainder | 10 | 0.6 | Si | 0 | 0 | 1340 | 2 | 2 | 10 | 4 |
| 2 | Remainder | 10 | 0.5 | P | 0 | 0 | 1340 | 2 | 2 | 10 | 4 |
| 3 | Remainder | 10 | 0.5 | Os | 0 | 4.4 | 1340 | 2 | 2 | 10 | 4 |
| 4 | Remainder | 10 | 0.12 | Si | 0 | 0 | 1340 | 2 | 2 | 10 | 4 |
| 5 | Remainder | 11 | 0.3 | Ru | 0 | 0 | 1340 | 2 | 2 | 10 | 4 |
| 6 | Remainder | 10 | 0.8 | Sn | 0 | 0 | 1340 | 2 | 2 | 10 | 4 |
| 7 | Remainder | 10 | 0.4 | Re | 0 | 0 | 1340 | 2 | 2 | 10 | 4 |
| 8 | Remainder | 10 | 0.6 | Ge | 0 | 0 | 1340 | 2 | 2 | 10 | 4 |
| 9 | Remainder | 10 | 0.1 | Sn | 0 | 0 | 1340 | 2 | 2 | 10 | 4 |
| 10 | Remainder | 10 | 0.6 | Ru | 0 | 0 | 1340 | 2 | 2 | 10 | 4 |
| 11 | Remainder | 10 | 0.6 | Ir | 0 | 0 | 1340 | 2 | 2 | 10 | 4 |
| 12 | Remainder | 10 | 0.6 | Pt | 0 | 0 | 1340 | 2 | 2 | 10 | 4 |
| 13 | Remainder | 10 | 0.6 | Re | 8 | 0 | 1340 | 2 | 2 | 10 | 4 |
| 14 | Remainder | 10 | 0.6 | Re | 0 | 4 | 1340 | 2 | 2 | 10 | 4 |
| 15 | Remainder | 1.00 | 0.01 | P | 0 | 0 | 1340 | 2 | 2 | 10 | 4 |
| 16 | Remainder | 10 | 0.5 | P | 0 | 0 | 1340 | 2 | 2 | 10 | 4 |
| 17 | Remainder | 10 | 0.1 | Os | 0 | 0 | 1340 | 2 | 2 | 10 | 4 |
| 18 | Remainder | 10 | 0.09 | Si | 0 | 0 | 1340 | 2 | 2 | 10 | 4 |
| 19 | Remainder | 10 | 0.6 | Re | 0 | 0 | 1340 | 2 | 2 | 10 | 4 |
| 20 | Remainder | 10 | 0.65 | Ru | 0 | 0 | 1340 | 2 | 2 | 10 | 4 |

TABLE 2

| | Mixing step | | | | | | Sintering step | | Cooling step | HIP step | |
|---|---|---|---|---|---|---|---|---|---|---|---|
| Sample No. | WC powder [% by mass] | Co powder [% by mass] | First element powder [% by mass] | Type of first element | TaC powder [% by mass] | TiCN powder [% by mass] | Temperature [° C.] | Holding time [hours] | Cooling rate [° C./min] | Pressure [MPa] | Time [hours] |
| 101 | Remainder | 1.00 | 0.01 | Os | 0 | 0 | 1340 | 2 | 2 | 10 | 4 |
| 102 | Remainder | 10 | 0.6 | P | 0 | 0 | 1340 | 2 | 2 | 10 | 4 |
| 103 | Remainder | 10 | 0.6 | Si | 0 | 5 | 1340 | 2 | 2 | 10 | 4 |
| 104 | Remainder | 10 | 0.6 | Re | 0 | 0 | 1380 | 1 | 10 | 10 | 1 |
| 105 | Remainder | 10 | 0.6 | Si | 0 | 0 | 1380 | 1 | 10 | 10 | 1 |

TABLE 2-continued

| | Mixing step | | | | | | Sintering step | | Cooling step | HIP step | |
|---|---|---|---|---|---|---|---|---|---|---|---|
| Sample No. | WC powder [% by mass] | Co powder [% by mass] | First element powder [% by mass] | Type of first element | TaC powder [% by mass] | TiCN powder [% by mass] | Temperature [° C.] | Holding time [hours] | Cooling rate [° C./min] | Pressure [MPa] | Time [hours] |
| 106 | Remainder | 10 | 0.6 | Ge | 0 | 0 | 1380 | 1 | 10 | 10 | 1 |
| 107 | Remainder | 10 | 0.6 | Sn | 0 | 0 | 1380 | 1 | 10 | 10 | 1 |
| 108 | Remainder | 10 | 0.6 | Os | 0 | 0 | 1380 | 1 | 10 | 10 | 1 |
| 109 | Remainder | 10 | 0.6 | Ir | 0 | 0 | 1380 | 1 | 10 | 10 | 1 |
| 110 | Remainder | 10 | 0.6 | Pt | 0 | 0 | 1380 | 1 | 10 | 10 | 1 |
| 111 | Remainder | 10 | 0.3 | P | 0 | 0 | 1380 | 1 | 10 | 10 | 1 |
| 112 | Remainder | 0.95 | 0.01 | P | 0 | 0 | 1340 | 2 | 2 | 10 | 4 |

TABLE 3

| Sample No | Content of WC grains [% by volume] | Content of binder phase [% by volume] | Total [% by volume] | Young's modulus of binder phase [GPa] | Co content [% by mass] | First element content [% by mass] | {M1/(M1 + M2)} × 100 [%] | Cutting test Cutting length [m] |
|---|---|---|---|---|---|---|---|---|
| 1 | Remainder | 19.3 | 100 | 195 | 10 | 0.6 | 5.7 | 52 |
| 2 | Remainder | 20.0 | 100 | 198 | 9.8 | 0.5 | 4.9 | 50 |
| 3 | Remainder | 15.2 | 89 | 175 | 10 | 0.5 | 4.7 | 50 |
| 4 | Remainder | 15.4 | 100 | 170 | 10 | 0.1 | 1.1 | 46 |
| 5 | Remainder | 16.4 | 100 | 185 | 11 | 0.3 | 2.5 | 48 |
| 6 | Remainder | 14.8 | 100 | 190 | 10 | 0.8 | 7.3 | 50 |
| 7 | Remainder | 15.1 | 100 | 186 | 10 | 0.4 | 3.7 | 48 |
| 8 | Remainder | 17.7 | 100 | 188 | 10 | 0.6 | 5.6 | 50 |
| 9 | Remainder | 16.4 | 100 | 173 | 10 | 0.1 | 1.0 | 46 |
| 10 | Remainder | 16.9 | 100 | 195 | 10 | 0.6 | 5.8 | 52 |
| 11 | Remainder | 16.7 | 100 | 188 | 10 | 0.6 | 5.7 | 50 |
| 12 | Remainder | 16.6 | 100 | 188 | 10 | 0.6 | 5.6 | 50 |
| 13 | Remainder | 16.6 | 91.7 | 195 | 10 | 0.6 | 5.6 | 52 |
| 14 | Remainder | 15.5 | 89.5 | 195 | 10 | 0.6 | 5.7 | 52 |
| 15 | Remainder | 1.8 | 100 | 173 | 1.0 | 0.01 | 1.0 | 46 |
| 16 | Remainder | 19.6 | 100 | 188 | 10 | 0.5 | 4.7 | 50 |
| 17 | Remainder | 16.3 | 100 | 180 | 10 | 0.1 | 1.0 | 48 |
| 18 | Remainder | 16.6 | 0.6 | 172 | 10 | 0.09 | 0.9 | 42 |
| 19 | Remainder | 16.7 | 100 | 188 | 10 | 0.6 | 5.8 | 50 |
| 20 | Remainder | 17.0 | 100 | 182 | 10 | 0.65 | 6.1 | 42 |

TABLE 4

| Sample No. | Content of WC grains [% by volume] | Content of binder phase [% by volume] | Total [% by volume] | Young's modulus of binder phase [GPa] | Co content [% by mass] | First element content [% by mass] | {M1/(M1 + M2)} × 100 [%] | Cutting test Cutting length [m] |
|---|---|---|---|---|---|---|---|---|
| 101 | Remainder | 1.7 | 100 | 183 | 1.0 | 0.01 | 1.0 | 28 |
| 102 | Remainder | 20.2 | 100 | 181 | 10 | 0.6 | 5.7 | 32 |
| 103 | Remainder | 17.8 | 88 | 180 | 10 | 0.6 | 5.6 | 34 |
| 104 | Remainder | 16.9 | 100 | 168 | 10 | 0.6 | 5.6 | 32 |
| 105 | Remainder | 16.6 | 100 | 166 | 10 | 0.6 | 5.5 | 32 |
| 106 | Remainder | 16.5 | 100 | 165 | 10 | 0.6 | 5.5 | 30 |
| 107 | Remainder | 16.9 | 100 | 162 | 10 | 0.6 | 5.6 | 32 |
| 108 | Remainder | 16.9 | 100 | 165 | 10 | 0.6 | 5.5 | 34 |
| 109 | Remainder | 16.9 | 100 | 163 | 10 | 0.6 | 5.8 | 32 |
| 110 | Remainder | 16.9 | 100 | 164 | 10 | 0.6 | 5.7 | 34 |
| 111 | Remainder | 16.9 | 100 | 168 | 10 | 0.3 | 2.8 | 32 |
| 112 | Remainder | 1.8 | 100 | 181 | 0.9 | 0.01 | 4.9 | 28 |

<<Characteristic Evaluation of Cemented Carbide>>

<Content of Tungsten Carbide Grains>

For the cemented carbide according to each sample, the content of the tungsten carbide grains was determined by the method described in Embodiment 1. The results obtained are described in the "Content of WC grains [% by volume]" column of Table 3 and Table 4. Note that "Remainder" being described in the "Content of WC grains [% by volume]" column of Table 3 and Table 4 means that the content of the tungsten carbide grains is a numerical value equal to the numerical value obtained by subtracting the numerical value described in the "Content of binder phase [% by volume]" column of Table 3 and Table 4 from the numerical value described in the "Total [% by volume]" column of Table 3 and Table 4.

<Content of Binder Phase>

For the cemented carbide according to each sample, the content of the binder phase was determined by the method described in Embodiment 1. The results obtained are described in the "Content of binder phase [% by volume]" column of Table 3 and Table 4.

<Young's Modulus of Binder Phase>

For the cemented carbide according to each sample, the Young's modulus of the binder phase was determined by the method described in Embodiment 1. The results obtained are described in the column of "Young's modulus [GPa]" of the column of "Binder phase" in Table 3 and Table 4.

<Content of Cobalt in Cemented Carbide>

For the cemented carbide according to each sample, the content of cobalt in the cemented carbide was determined by the method described in Embodiment 1. The results obtained are described in the "Co content [% by mass]" column of Table 3 and Table 4. Note that, for the cemented carbide according to each sample, "cobalt in cemented carbide 3 is present only in binder phase 2" was confirmed by the method described in Embodiment 1.

<Content of First Element in Cemented Carbide>

For the cemented carbide according to each sample, the content of the first element in the cemented carbide was determined by the method described in Embodiment 1. The results obtained are described in the "First element content [% by mass]" column of Table 3 and Table 4. Note that, for the cemented carbide according to each sample, in the case where the "First element content [% by mass]" is not 0% by mass, "the first element in cemented carbide 3 is present only in binder phase 2" was confirmed by the method described in Embodiment 1.

$$<\{M1/(M1+M2)\}\times 100>$$

For the cemented carbide according to each sample, $\{M1/(M1+M2)\}\times 100$ was determined by the method described in Embodiment 1. The results obtained are described in the "$\{M1/(M1+M2)\}\times 100$ [%]" column of Table 3 and Table 4.

<<Cutting Test>>

At first, by processing the round bar composed of the cemented carbide according to each sample, an end mill with a drill diameter of 6 mm was produced as a cutting tool according to each sample. Next, using the end mill of each sample, cutting was performed under the following cutting conditions, and the cutting length until breakage occurred in the end mill was measured. The results obtained are each described in the "Cutting length [m]" column of Table 3 and Table 4. Note that a longer cutting length indicates a longer tool life.

<Cutting Conditions>

Workpiece: "Hastelloy C276" ™ manufactured by Osaka Stainless Co., Ltd. (difficult-to-cut material with high tensile strength)

Cutting speed Vc: 45 m/min

Feed per drill Fz: 0.2 mm/t

Cut depth in axial direction ap: 1 mm

Cut depth in radial direction ae: 0.3 mm

Cutting fluid: used (wet)

The above cutting conditions correspond to high efficiency processing of difficult-to-cut materials with high tensile strength.

The cemented carbides according to Samples 1 to 20 correspond to Examples. The cemented carbides according to Samples 101 to 112 correspond to Comparative Examples. From the results of Table 3 and Table 4, it was found that the cemented carbides according to Samples 1 to 20 enable a longer service life of tools, even in the case where they are used as a material for cutting tools for high efficiency processing of difficult-to-cut materials with high tensile strength, compared to the cemented carbides according to Samples 101 to 112.

From the above, it was found that the cemented carbides according to Samples 1 to 20 enable a longer service life of tools, even in the case where they are used as a material for cutting tools for high efficiency processing of difficult-to-cut materials with high tensile strength.

Although the embodiments and Examples of the present disclosure have been described above, it has been planned from the beginning that the configurations of the embodiments and Examples described above may be appropriately combined or modified in various ways.

It should be understood that the embodiments and Examples disclosed herein are illustrative in all respects and are not restrictive. The scope of the present invention is defined not by the above-described embodiments and Examples but by the claims, and is intended to include meanings equivalent to the claims and all modifications within the scope.

REFERENCE SIGNS LIST

1 Tungsten carbide grain; 2 Binder phase; 3 Cemented carbide.

The invention claimed is:

1. A cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume to 20.0% by volume of the binder phase, the binder phase contains cobalt, the cemented carbide contains 1.0% by mass or more of cobalt, and a Young's modulus of the binder phase at 25° C. is 170 GPa to 198 GPa, as measured by a nanoindenter method.

2. The cemented carbide according to claim 1, wherein the binder phase further contains a first element, and the first element is at least one element selected from the group consisting of silicon, phosphorus, germanium, tin, rhenium, ruthenium, osmium, iridium, and platinum.

3. The cemented carbide according to claim 2, wherein, in the binder phase, a percentage $\{M1/(M1+M2)\}\times 100$ of a mass M1 of the first element to a sum M1+M2 of the mass M1 of the first element and a mass M2 of cobalt is 1% to 6%.

4. The cemented carbide according to of claim 1, wherein the binder phase further contains a first element, and the first element is at least one element selected from the group consisting of silicon, phosphorus, germanium, tin, rhenium, osmium, iridium, and platinum.

5. The cemented carbide according to claim 2, wherein, wherein, in the binder phase, a percentage $\{M1/(M1+M2)\}\times 100$ of a mass M1 of the first element to a sum M1+M2 of the mass M1 of the first element and a mass M2 of cobalt is 1% to less than 5%.

6. The cemented carbide according to claim 1, wherein the cemented carbide is prepared by:

preparing raw material powders of materials that constitute the cemented carbide, mixing each raw material powder at a predetermined proportion to form a mixed powder, molding the mixed powder into a shape for cutting tools to obtain a molded body, sintering the molded body to obtain a cemented carbide intermediate, cooling the cemented carbide intermediate, and performing a hot isostatic pressing (HIP) on the cemented carbide intermediate after performing the cooling.

7. The cemented carbide according to claim 6, wherein:

the sintering includes heating to at least 1,340° C. for at least two hours, and the cooling includes cooling to 800° C. or lower at a cooling rate of 2° C./min or lower.

* * * * *